US007604511B1

(12) United States Patent
Johnson

(10) Patent No.: US 7,604,511 B1
(45) Date of Patent: Oct. 20, 2009

(54) ELECTRICAL ADAPTOR

(76) Inventor: Steve O. Johnson, 22528 W. Chicago Rd., Redford, MI (US) 48239

( * ) Notice: Subject to any disclaimer, the term of this patent is extended or adjusted under 35 U.S.C. 154(b) by 86 days.

(21) Appl. No.: 11/841,249

(22) Filed: Aug. 20, 2007

Related U.S. Application Data

(63) Continuation-in-part of application No. 11/474,657, filed on Jun. 26, 2006, now abandoned.

(51) Int. Cl.
*H01R 25/00* (2006.01)

(52) U.S. Cl. ..... 439/651

(58) Field of Classification Search ..... 439/651, 439/105–107, 535, 650–655, 692, 954, 638; 174/53–58, 66
See application file for complete search history.

(56) References Cited

U.S. PATENT DOCUMENTS

| | | | | |
|---|---|---|---|---|
| 3,579,175 | A | 5/1971 | Shroyer | |
| 3,813,640 | A | 5/1974 | Carissimi | |
| 3,951,487 | A | 4/1976 | Waldbrook | |
| 5,171,168 | A | 12/1992 | Chiodo | |
| 5,399,093 | A | 3/1995 | Schneider et al. | |
| 5,554,039 | A | 9/1996 | Doudon | |
| 5,679,026 | A | 10/1997 | Fain et al. | |
| 5,775,921 | A | 7/1998 | Chou | |
| 5,957,701 | A | 9/1999 | McMillan | |
| 5,997,310 | A | 12/1999 | Chiu et al. | |
| 6,004,138 | A | 12/1999 | Harbertson | |
| 6,089,921 | A | 7/2000 | Chou | |
| 6,315,617 | B1 * | 11/2001 | Al-Sabah | 439/652 |
| 6,595,782 | B1 | 7/2003 | Hsiao | |
| 6,663,396 | B1 | 12/2003 | Wang | |
| 6,709,297 | B2 | 3/2004 | Lee | |
| D489,328 | S * | 5/2004 | Oswalt | D13/137.1 |
| 6,793,499 | B1 | 9/2004 | Chen | |
| D559,783 | S * | 1/2008 | Matzdorff et al. | D13/137.2 |
| 2002/0173187 | A1 | 11/2002 | Schmitt | |

* cited by examiner

*Primary Examiner*—Edwin A. Leon
(74) *Attorney, Agent, or Firm*—Gable Gotwals

(57) ABSTRACT

An electrical adaptor providing access to an electrical receptacle with an object placed in close proximity directly in front of the receptacle. The electrical adaptor having a pair of male connectors with a center line; a pair of female connectors having a center line; the female connectors in electric conductive communication with the male connectors; a rigid single section body having a bend such that the center line of the female conductors is oriented and fixed at an angle of 90° relative to the center line of the male connectors and the center line of the female connectors is oriented and fixed at an angle of 30° to 60° from a plane formed by the male connectors; and the body extending from the male connectors to the female connectors.

10 Claims, 4 Drawing Sheets

ELECTRICAL ADAPTOR

REFERENCE TO PENDING APPLICATIONS

This application is a continuation-in-part patent application claiming priority to U.S. patent application Ser. No. 11/474,657, filed on Jun. 26, 2006.

REFERENCE TO MICROFICHE APPENDIX

This application is not referenced in any microfiche appendix.

FIELD OF THE INVENTION

The present invention is generally directed towards an improved electrical adaptor. More specifically, the present invention provides an adaptor which can be used to provide access to an electrical receptacle located behind a piece of furniture while allowing the furniture to sit tightly against the wall. Further the present invention provides the ability to use an appliance with a grounded plug in both sockets of an ungrounded receptacle while providing the ability to ground two of the adaptors the present invention to the grounding screw on the outlet.

BACKGROUND OF THE INVENTION

Electricity is a modern day necessity. Any building or home built today in the United States is wired for electricity. In wiring these homes and buildings, electric receptacles are placed throughout the building and are typically located on the lower section of walls. Once these homes and buildings are occupied furniture often must be placed in front of a receptacle. The occupant is often faced with the dilemma of either placing the furniture several inches out from the wall so that the receptacle can be accessed for use or placing the furniture flush against the wall, thus leaving the receptacle inaccessible for use.

This problem is compounded when the occupant has an appliance which has a grounded plug and the receptacle is ungrounded.

One possible option in the past has been the use of an extension cord. However, extension cords can be a fire hazard and a trip hazard in certain applications. They also present unsightly clutter.

Other adaptors have been presented to solve this problem however they typically are rather complicated devices with moving parts which increase the likelihood of failure of the adaptor.

Addressing the issue of plugging the grounded plug into the ungrounded receptacle, the occupant has had one of three unsatisfactory options to solve this problem. The first option would be to cut off the grounding prong on the plug, however this leaves the appliance ungrounded and thus presents a danger of electrocuting the occupant.

The second option would be to employ an adaptor plug which has a ground wire extending from it. The grounded appliance plug is simply inserted into the female end of the adaptor. The adaptor is then plugged into the receptacle and the grounding wire is secured to the grounding screw on the face of the receptacle. While this does allow for grounding of the appliance, the extra step of having to unscrew and then reattach grounding screw with the grounding wire is inconvenient as many times the occupant does not have a screw driver handy. Also as the adaptor ages the coating on the grounding wire can become brittle and break and the wire can become frayed thus creating a danger of electrocution and/or fire.

The third option would be to use an adaptor plug having a metal grounding tab extending parallel with the male face of the adaptor. This operates in much the same way as the adaptor described above. The grounded appliance plug is inserted into the female end of the adaptor. The plug can then be inserted into the ungrounded receptacle. In order to provide grounding, the grounding screw on the receptacle must be removed and used to secure the grounding tab to the receptacle. In addition to having the same drawbacks as the adaptor with the grounding wire the adaptor with a grounding tab can only provide grounding when used in the top receptacle. If the adaptor is inserted in the bottom receptacle the grounding tab extends in the direction opposite the receptacle grounding screw.

The other draw back of using either one of these adaptors is that they cause the plug to stick out further from the wall, typically 1" to 1½" thus further complicating the location of furniture in front of the receptacle.

BRIEF SUMMARY OF THE INVENTION

The present invention is an electrical adaptor which provides a solution to the shortcomings of the prior art by providing a small rigid single piece electrical adaptor which can be plugged into a receptacle to redirect the interface of the receptacle such that when a plug is connected to it the cord from the plug will hang at an angle parallel with the wall.

Another embodiment provides a hinged male grounding prong or third male connector. This hinged third male connector provides the ability to ground two grounded appliances to the grounding screw of the electrical outlet.

A better understanding of the invention will be obtained from the following detailed description of the preferred embodiments taken in conjunction with the drawings and the attached claims.

DETAILED DESCRIPTION OF THE PREFERRED EMBODIMENTS

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

Figure 1:
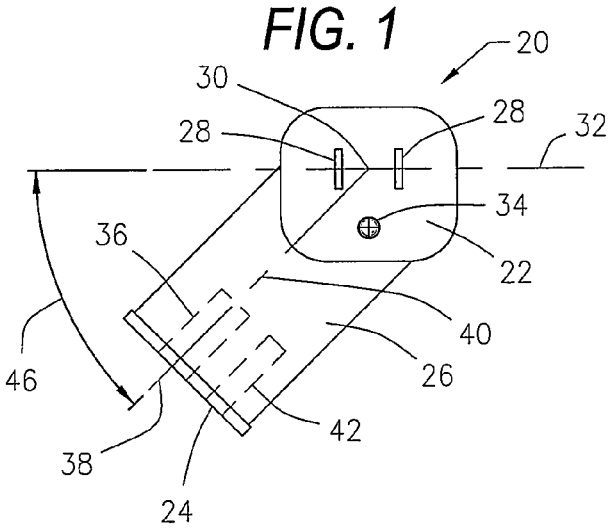
FIG. 1 shows a front view of one embodiment of the present invention.
Figure 2:
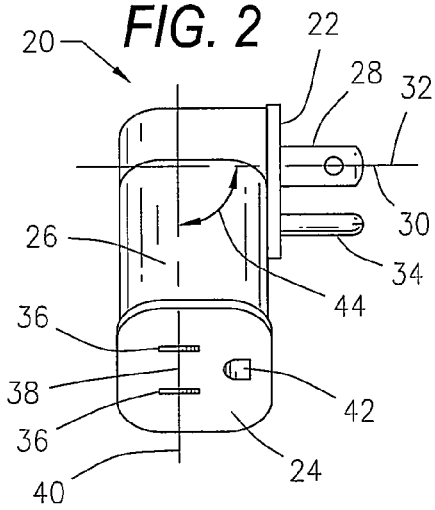
FIG. 2 shows a side view of the embodiment shown in FIG. 1.

Referring to FIGS. 1 and 2 which show the electrical adaptor 20 of the present invention. The adaptor 20 has a male face 22 and a female face 24 located on opposite ends of a body 26. The male face 22 has a pair of male connectors 28. The connectors 28 have a center line 30. The male connectors 28 also define a plane 32. A third male connector 34 can be located on the male face 22 parallel with the pair of male connectors. In typical applications of the adaptor 20 in a 120V system one of the pair of male connectors 28 will be the hot or electrified wire while the second electrical connector in the pair of male connectors is for the neutral side of the circuit. The third male connector 34 is typically the ground.

The female face 24 of the adaptor 20 has a pair of female connectors 36 with a center line 38. The pair of female connectors 36 also define a plane 40. The female face 24 can also have a third female connector 42 parallel with the pair of female connectors 36.

When the adapter 20 has been used with a typical 120V system, one of the female connectors of the pair of female connectors 36 is the hot wire with the other connector of the pair of female connectors 36 being the neutral wire. The third female connector 42 is typically the ground.

The hot connector of the pair of male connectors 28 is in electric conductive communication with the hot connector of the pair of female connectors 36. Likewise the neutral connector of the pair of male connectors 28 is in electric conductive communication with the neutral female connector of the pair of female connectors 36. The third male connector 34 is also in electric conductive communication with the third female connector 42. The male face 22 is typically disposed on the opposite end of the body 26 from the female face 24.

In the first embodiment the body is configured such that the center line 30 of the pair of male connectors 28 is perpendicular to the center line 38 of the pair of female connectors 36. This angle is indicated by element 44 in FIG. 2. The center line 38 of the pair of female connectors 36 is also at an angle 46 relative to the plane 32 of the pair of male connectors 28. This angle 46 can range from 30-60° with the preferred embodiment being 45°.

Figure 3:
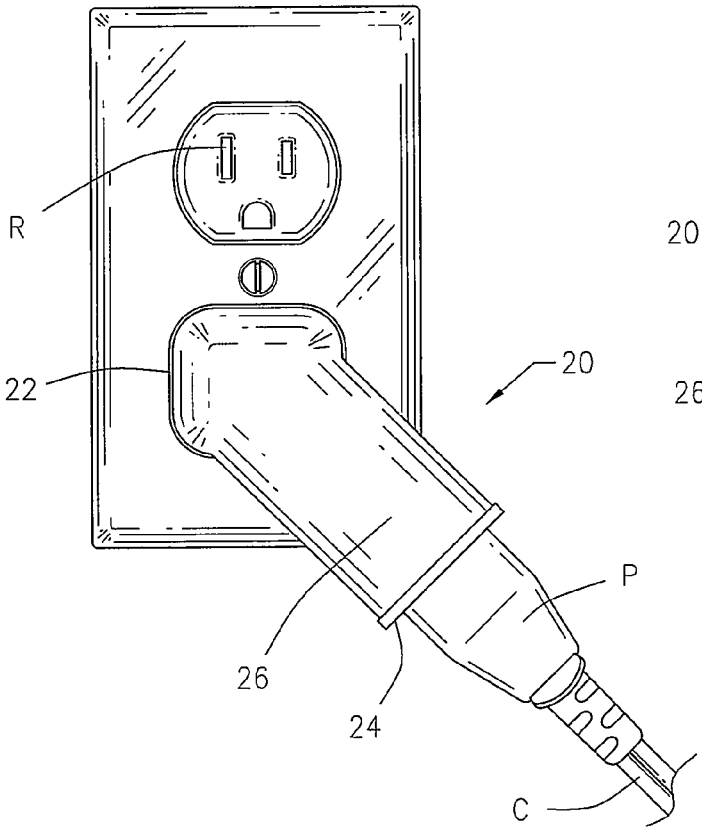
FIG. 3 shows a front view of one embodiment of the adaptor of the present invention in use with a receptacle, a plug and a cord.
Figure 4:
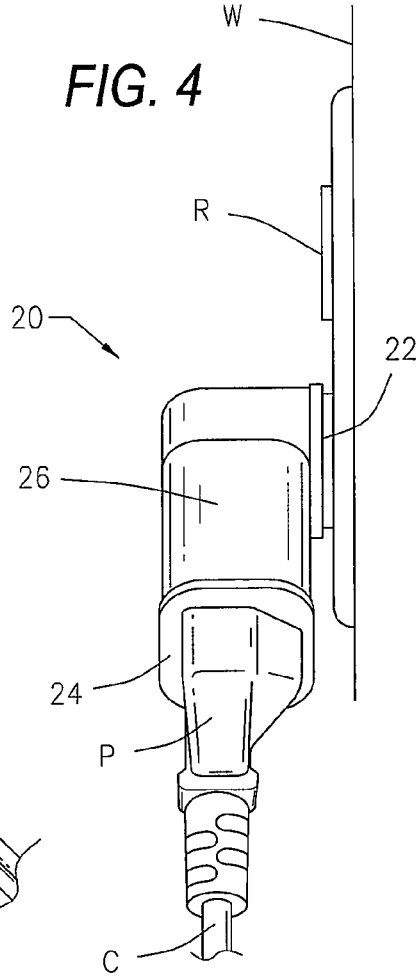
FIG. 4 shows a side view of the adaptor, plug and cord in use with a receptacle shown in FIG. 3.

FIGS. 3 and 4 show the adaptor 20 of the present invention in use with a typical 120V receptacle R and an electrical plug P. When in use the pair of male connectors 28 and third male connector 34 are inserted into the female receptacle R. An electrical plug P can then be attached to the pair of female connectors 36 and third female connector 42. This allows the plug P and its cord C to lie flush with the wall W. This in turn allows for any furniture standing in front of the receptacle R to be pushed close to the wall W while still allowing the plug P to be connected and disconnected from the adapter 20 and in turn the receptacle R.

Figure 5:
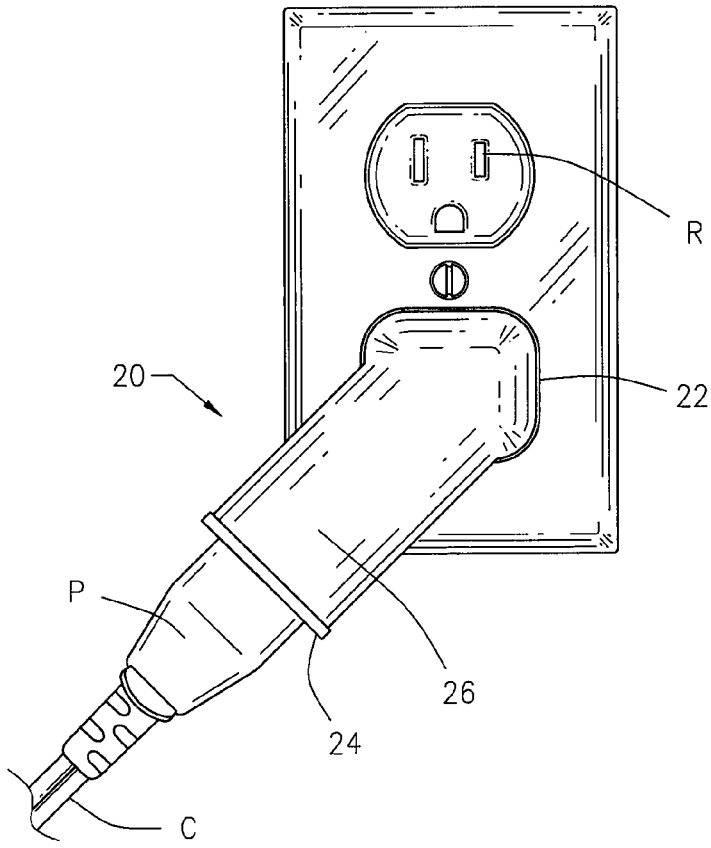
FIG. 5 shows a front view of second embodiment of the present invention in use with a receptacle, a plug and a cord.

FIG. 5 shows a second embodiment of the adaptor 20 of the present invention in use with a typical 120V receptacle R and an electrical plug P. FIG. 5 is included to illustrate the adaptor of the present invention can angle to the left (as shown in FIG. 5) in addition to angling to the right (as shown in FIG. 3). Other than the difference in the direction of angle, the embodiment shown in FIG. 5 is structurally the same as the embodiment shown in FIGS. 1 through 4. The two embodiments also operate in the same manner.

While the example shown in the figures is a three prong outlet with a ground or third connector 34 and 42, the invention can also be implemented using just the male and female pair of connectors 28 and 36. Likewise the invention can also be used on circuits with electrical voltages other than 120V.

Figure 6:
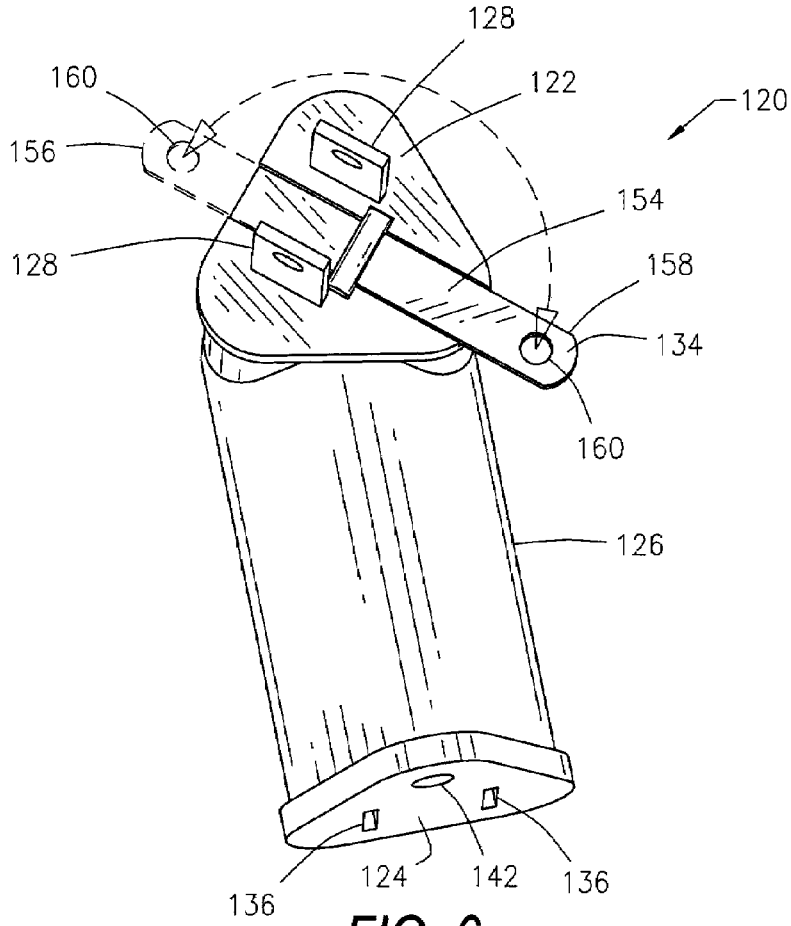
FIG. 6 shows a perspective view of a third embodiment of the present invention.

Turning now to FIG. 6, the third embodiment of the electrical adaptor 120 of the present invention has a male face 122 and a female face 124 on either end of the body 126. A pair of male connectors 128 extend from the male face 122 as does a hinged third male connector 134. A pair of female connectors 136 and a third female connector 142 extend into the body 126 of the adaptor 120 from the female face 124. Each of the male connectors 128 are in electric conductive communication with one of the female connectors 136. The third male connector 134 is in electric conductive communication with the third female connector 142.

When the adaptor 120 is used with a 120V AC system one of the connectors of the pair of male connectors 128 will be the hot or electrified wire. The second male electrical connector in the pair 128 is the neutral side of the circuit. The third male connector 134 is the ground. Likewise one of the female connectors of the pair of female connectors 136 is the hot or electrified wire with the other connector being the neutral wire. The third female connector 142 is the ground. The hot connector of the pair of male connectors 128 is in electric conductive communication with the hot connector of the pair of female connectors 136. Likewise the neutral connector of the pair of male connectors 128 is in electric conductive communication with the neutral female connector. The third male connector 134 is also in electric connective communication with the third female connector 142.

Figure 7:
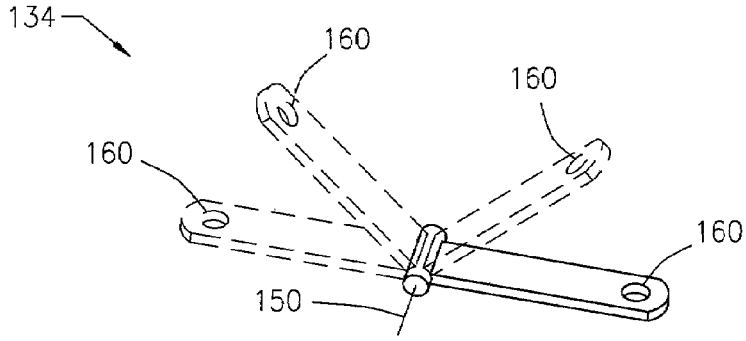
FIG. 7 shows the detail of the hinged third male connector.

Turning to FIG. 7 the third male connector 134 is hinged such that it can rotate approximately 180° and/or to at least 3 positions. The embodiment shown in FIG. 7 uses a pin 150 to pivotally secure the third male connector 134 to the adaptor 120. While FIG. 7 shows use of a pin 150 it is understood that there are other ways to hingedly attach a member. Use of these other methods of hingedly attaching a member would still fall within the scope of the present invention.

Looking at FIG. 6, the male face 122 of the adaptor 120 has a first and second trench 152 and 154 which extend across the male face 122 away from the hinged third male connector 134. The trenches 152 and 154 are located and sized such that when the third male connector 134 is in the first position indicated by element 156, the cross-section of the third male connector 134 is contained inside the first trench 152. Likewise when the third male connector 134 is in the second position, indicated by element 158, the cross-section of the third male connector 134 is contained in the second trench 154. The first and second position 156 and 158 are perpendicular to the pair of male connectors 128 and/or the plane defined by the male connectors. The third male connector 134 has a length such that when it is in the first or second position 156 or 158 it extends beyond the male face 122 of the adaptor 120. There is an aperture 160 which, passes through the third male connector 134. The aperture 160 is located and sized such that when the third male connector 134 is in the first or second position 156 or 158 the hole will align with the grounding screw of an electrical plug P.

Figure 8:
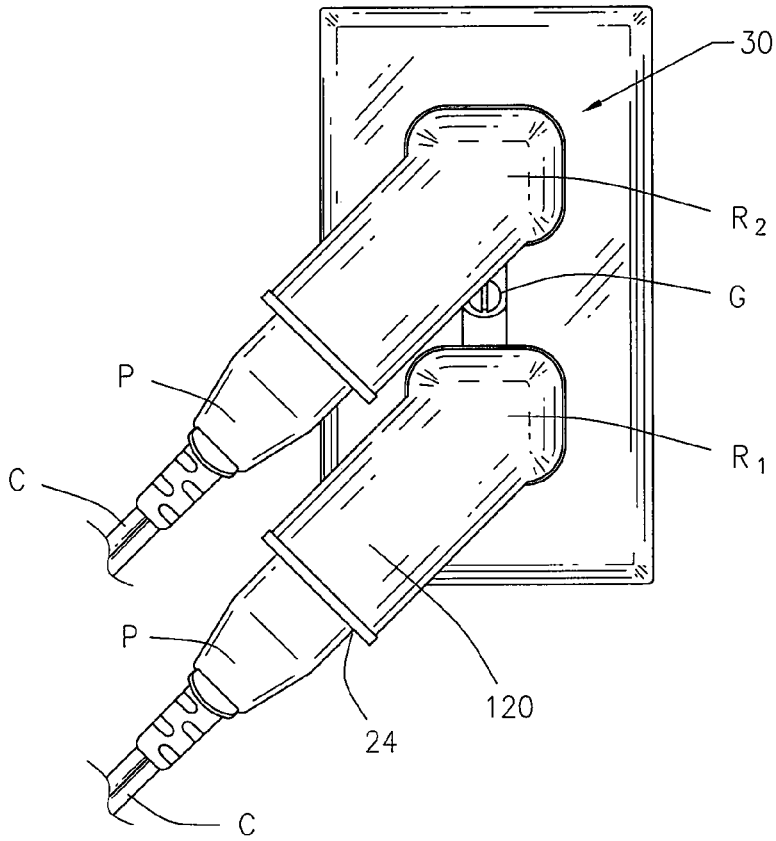
FIG. 8 shows two adapters of the third embodiment in use with an ungrounded outlet.

When the third embodiment of the invention is used with a grounded receptacle the third male connector 134 can be set in a third position such that it is parallel with the pair of male connectors 128. If the adaptor 120 is used with an appliance having a grounded plug in an ungrounded electrical outlet. The grounded plug is inserted into the female connectors 136 and 142. If the adaptor is inserted in the lower receptacle $R_1$ as shown in FIG. 8, the third male connector 134 would be placed in the first position 156, such that it is perpendicular with the pair of male connectors 128. The grounding screw G of the receptacle would be removed. The male connectors 128 of the adaptor 120 would be inserted into the lower receptacle $R_1$ and the grounding screw G would be inserted through the aperture 160 of the third male connector 134 and screwed back into the electrical plug P.

If it is necessary to use both the bottom and top receptacle $R_1$ and $R_2$ of an ungrounded electrical plug P as shown in FIG. 8 the grounded plug P of the appliance would be inserted into the female connectors 136 and 142 of the adaptor 120. The third male connector 134 would be placed in the second position 158, such that it is perpendicular to the pair of male connectors 128. The grounding screw G would be removed from the electrical plug P. The third male connector 134 can then be placed in the second position 158. The pair of male connectors 128 could then be inserted into the top receptacle $R_2$. The grounding screw G would then be passed through the aperture 160 of both the adaptor 120 and the lower receptacle R1 and the aperture 160 of the adaptor 120 located in the top receptacle R2. The grounding screw would then be screwed into the electrical plug P. This would allow two appliances with grounded plugs P to simultaneously be plugged into the same ungrounded electrical plug P while providing a ground connection.

In addition to using the hinged third male connector 134 with an angled adaptor 20 and 120 such as shown in FIGS. 1-6 and 8, the hingedly attached third male connector 134 could also be used in an adaptor wherein the pair of male connectors 28 and 128 are in a straight or paralleled alignment with a pair of female connectors 36 and 136.

The adaptors 20 and 120 of the present invention can be constructed out of any materials commonly known in the art. This includes but is not limited to using polymers, resins and other electrically nonconductive, materials for the body 26 and 126. The connectors 28, 34, 36, 42, 128, 134, 136 and 142 can be fabricated out of any electrically conductive materials known in the art, typically various metals and alloys.

While the invention has been described with a certain degree of particularity, it is manifest that many changes may be made in the details of constriction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. An electrical adaptor comprising:

a body having a male face and a female face;

a pair of male connectors defining a plane and having a center line, said pair of male connectors extending from said male face;

a hinged third male connector extending from said male face, said third male connector moveable between at least a first, a second and a third position wherein said first and second positions are perpendicular to said plane defined by said pair of male connectors and said third position is parallel with said pair of male connectors;

a first and a second trench each extending across said male face from said third male connector, said first and second trench located and sized to contain said third male connector when placed in said first and second position respectively;

a pair of female connectors having a center line and extending into said body from said female face;

a third female connector parallel with said pair of female connectors and extending into said adaptor from said female face; and each of said pair of female connectors in electric conductive communication with one of said pair of male connectors and said third female connector in electric conductive communication with said third male conductor.

2. The adaptor of claim 1, wherein said third male connector extends beyond said male face when oriented in said first or second positions.

3. The adaptor of claim 1, wherein said body is further comprising:

a bend such that said center line of said pair of female conductors is oriented and fixed at 90° relative to said center line of said pair of male connectors and said center line of said pair of female connectors is oriented and fixed at an angle of 45° from said plane defined by said pair of male connectors; and said body extends from said male face to said female face.

4. An electrical adaptor comprising:

a body having a male face and a female face;

a pair of male connectors defining a plane and having a center line, said pair of male connectors extending from said male face;

a hinged third male connector extending from said male face, said third male connector moveable between at least a first, a second and a third position wherein said first and second positions are perpendicular to said plane defined by said pair of male connectors and said third position is parallel with said pair of male connectors;

a first and a second trench each extending across said male face from said third male connector, said first and second trench located and sized to contain said third male connector when placed in said first and second position respectively;

a pair of female connectors having a center line and extending into said body from said female face;

a third female connector parallel with said pair of female connectors and extending into said adaptor from said female face; and each of said pair of female connectors in electric conductive communication with one of said pair of male connectors and said third female connector in electric conductive communication with said third male conductor;

wherein said third male connector extends beyond said male face when oriented in said first or second positions; and said body has a bend such that said center line of said pair of female conductors is oriented and fixed at 90° relative to said center line of said pair of male connectors and said center line of said pair of female connectors is oriented and fixed at an angle of 45° from said plane defined by said pair of male connectors; and said body extends from said male face to said female face.

5. An electrical adaptor comprising:

a body having a male face and a female face;

a pair of male connectors defining a plane and having a center line, said pair of male connectors extending from said male face;

a hinged third male connector extending from said male face said third male connector moveable between at least a first and second position, wherein said first position is perpendicular to said plane defined by said pair of male connectors and said second position is parallel with said pair of male connectors;

a pair of female connectors having a center line and extending into said body from said female face;

a third female connector parallel with said pair of female connectors and extending into said adaptor from said female face; and each of said pair of female connectors in electric conductive communication with one of said pair of male connectors and said third female connector in electric conductive communication with said third male conductor.

6. The adaptor of claim 5 further comprising:

a trench extending across said male face from said third male connector, said trench located and sized to contain said third male connector when placed in said first position.

7. The adaptor of claim 6, wherein said third male connector extends beyond said male face when oriented in said first position.

8. The adaptor of claim 5 further comprising:

said third male connector moveable between at least said first position, said second position and a third position;

wherein said third position is perpendicular to said pair of male connectors.

9. The adaptor of claim 8 further comprising:

a trench extending across said male face from said third male connector, said trench located and sized to contain said third male connector when placed in said third position.

10. The adaptor of claim 9, wherein said third male connector extends beyond said male face when oriented in said third position.

* * * * *